US009898907B1

(12) United States Patent
Xin

(10) Patent No.: US 9,898,907 B1
(45) Date of Patent: Feb. 20, 2018

(54) THEFT-PREVENTION EXHIBITION DEVICE AND METHOD

(71) Applicant: HANGZHOU LANGHONG TECHNOLOGY CO., LTD., Hangzhou (CN)

(72) Inventor: Hong Xin, Hangzhou (CN)

(73) Assignee: Hangzhou Langhong Technology Co., Ltd., Hangzhou (CN)

( * ) Notice: Subject to any disclaimer, the term of this patent is extended or adjusted under 35 U.S.C. 154(b) by 0 days.

(21) Appl. No.: 15/431,709

(22) Filed: Feb. 13, 2017

(30) Foreign Application Priority Data

Aug. 16, 2016 (CN) ..... 2016 1 0680173

(51) Int. Cl.
*G08B 13/14* (2006.01)

(52) U.S. Cl.
CPC ..... *G08B 13/1445* (2013.01)

(58) Field of Classification Search
CPC ..... G08B 13/1427; G08B 13/1445; G08B 13/149; A47F 7/024; G06Q 30/02
See application file for complete search history.

(56) References Cited

U.S. PATENT DOCUMENTS 5,068,643 A * 11/1991 Yashina ..... G08B 13/1436 250/215
5,638,049 A * 6/1997 Arakawa ..... A47G 1/1686 340/568.8
5,914,658 A * 6/1999 Arakawa ..... A47G 1/1686 340/531
2007/0229259 A1* 10/2007 Irmscher ..... A47F 7/024 340/568.2
2010/0188221 A1* 7/2010 Irmscher ..... A47F 7/024 340/568.1
2010/0188222 A1* 7/2010 Irmscher ..... A47F 7/024 340/568.2
2010/0188223 A1* 7/2010 Irmscher ..... A47F 7/024 340/568.2
2010/0191651 A1* 7/2010 Irmscher ..... A47F 7/024 705/50
2010/0194568 A1* 8/2010 Irmscher ..... A47F 3/002 340/568.3
2011/0241870 A1* 10/2011 Irmscher ..... A47F 7/024 340/539.1
2012/0032802 A1* 2/2012 Irmscher ..... A47F 3/002 340/568.2
2013/0049961 A1* 2/2013 Irmscher ..... A47F 3/002 340/568.3

* cited by examiner

*Primary Examiner* — Orlando Bousono
(74) *Attorney, Agent, or Firm* — Liang Legal Group, PLLC

(57) ABSTRACT

A theft-prevention exhibition device includes a first unit, which comprises a microprocessor, a radiofrequency (RF) transceiver, a first alarm, a first switch, a power source, wherein the microprocessor is electrically connected with the RF transceiver, the first alarm, and the first switch; a second unit, which comprises a memory, a magnetic induction coil, and a wire retractor; a connecting plate adapted to be connected to a display item, wherein the connecting plate comprises a second switch; a wire rope spooled on the wire retractor and connected to the connecting plate, wherein the wire rope connects with the second switch, the memory, and the magnetic induction coil to form a circuit.

7 Claims, 4 Drawing Sheets

THEFT-PREVENTION EXHIBITION DEVICE AND METHOD

CROSS REFERENCE TO RELATED APPLICATIONS

This application claims the priority of Chinese Patent Application No. 201610680173.1, filed on Aug. 16, 2016, the disclosure of which is incorporated by reference in its entirety.

BACKGROUND OF INVENTION

Field of the Invention

The present invention relates to the theft-prevention technical field of wholesale digital products, in particular to theft-prevention exhibition devices and methods.

Background Art

Normally, customers prefer to experience electronic equipment that interests them prior to purchases. Therefore, retails of electronic devices have gradually transformed from enclosed exhibition/display to an open display environment such that the user can touch and play with the devices (e.g., cell phones and pads).

Currently, the following theft-prevention technologies for retail experience are available on the market:

(1) Purely physical theft-prevention technology: this technique is inflexible and provides unsatisfactory user experience;

(2) Electrical connection-based theft-prevention technology: with this technology, all theft-prevention contacts and interfaces are connected to a theft-prevention host by means of electrical connections. This technology also has disadvantages as it requires complicated wiring, has limited service lives, and provides unsatisfactory user experience; and (3) Active communication-based identification technology: Because the object of identification includes batteries necessary for active communication, the profile of the object is restricted. This technology has disadvantages of being bulky, providing unsatisfactory user experience, and demanding relatively stringent requirements for the environment.

SUMMARY OF INVENTION

An object of the present invention is to overcome one or more such disadvantages of unsatisfactory user experience, complicated wiring, or stringent requirements for the environment for the exhibition device in the prior art, and to provide theft-prevention exhibition devices and methods that feature satisfactory user experience, simple wiring, and/or serviceability in a poor environment.

Embodiments of the present invention may involve the following technical features:

A theft-prevention display/exhibition device comprises a first unit having a first shell, a second unit having a second shell, and a connecting plate configured to be connected to a display object. A "device" of the invention may also be referred to as a "system" because it comprises separate units (e.g., the first unit and the second unit with various components contained therein). For clarity, the term "device" will be used in this description. However, one skilled in the art would appreciate that the term theft-prevention "device" and theft-prevention "system" may be used interchangeably in most situations described herein.

In accordance with embodiments of the invention, the first unit comprises, in the first shell, a microprocessor, a transceiver (e.g., an RF transceiver), a first alarm, a first switch that can be turned on/off from outside the first shell (e.g., a switch exposed outside the first shell, or an inductive or capacitive switch inside the first shell, or the like), and a power supply (e.g., a rechargeable or non-rechargeable battery or another power source such as a power unit adapted to be connected to an electrical outlet). In the first unit, the microprocessor is electrically connected with the transceiver, the first alarm, and the first switch.

In accordance with embodiments of the invention, the second unit comprises, in the second shell, a memory (i.e., a storage device), a magnetic induction coil, and a wire winder (wire retractor). A wire rope on the wire winder is connected to the connecting plate, which is configured to be attached (e.g., via glue, Velcro, or the like) to a display item (e.g., a cell phone or a tablet). In accordance with some embodiments of the invention, a second switch may also be provided on the connecting plate for indicating the attachment status of the display item. An exemplary embodiment of the second switch may be a contact switch, which is pressed when the connecting plate is connected with (e.g., glued to) the display item and is released when the display item is not connected with the connecting plate. A second switch may also be based on a proximity sensor (e.g., an inductance or capacitance type sensor) or the like.

The wire rope may comprise any suitable wire, such as a regular two-conductor wire, a twisted pair wire, or a coaxial (e.g., one with a core wire and a cover wire (i.e., a sheath wire) with an insulating layer between the core wire and the cover wire). The two wires of the wire rope (e.g., the core wire and the cover wire) are connected with the second switch, and then further connected to the storage device and the magnetic induction coil to form a circuit.

The connecting plate is configured to be attached to a display item during use. The connecting plate may optionally comprise a second switch/sensor to detect whether the connecting plate is detached from the display item. For clarity, the term "second switch" will be used in this description. However, one skilled in the art would appreciate that the "second switch" may be a "sensor," such as a inductive or capacitive sensor. Any switch for sensing the status of presence or absence of the display item may be used with embodiments of the invention. For example, such a switch may be a contact switch, an inductive sensor, a capacitive sensor, or the like.

In accordance with embodiments of the invention, the first unit and the second unit can communicate wirelessly (e.g., via Bluetooth or WIFI or the like). Therefore, the first unit and the second unit can be optionally placed separately, and no physical connection between the two is required. For wireless communication, the processor in the first unit may control the RF transceiver in the first shell to send RF signals, which may function as RFID interrogation signals or may generate an EM field. If the second unit is placed within a selected distance from the first unit such that the second unit is within the EM field, then the second unit may sense the RF signals or EM field from the first unit and send a signal (e.g., RFID), using the magnetic induction coil therein, back to the first unit in response to the RF signals or EM field.

In accordance embodiments of the invention, the second unit may send back an ID information (e.g., RFID or similar ID information) to the transceiver in the first unit such that the microprocessor is aware that the second unit is within the preset distance. If the second unit is outside of the preset range, the wireless communication would be interrupted. By using the RFID (or similar) technology, the second unit may not need any active power source (i.e., passive RFID) or need only minimal power (e.g., a small battery such as a watch cell battery) for semi-passive RFID. In preferred embodiments, the second unit does not have any active power source and the unit communicates via passive RFID. The RFID is sent in response to the RF or EM transmission from the first unit. Because no (or minimal) active power source is required for the second unit, the second unit can be more compact and easier to maintain or service.

In accordance with embodiments of the invention, when the first switch is pressed (i.e., turned on), the circuit in the first unit is activated and the microprocessor will control the transmission of an RF or electromagnetic wave from the RF transceiver to probe the presence of the second unit (i.e., RFID tags contained therein) in the vicinity of the first unit. In accordance with some embodiments of the invention, the microprocessor may be programmed to probe the second unit (i.e., the RFID tags) constantly (or with very short time intervals between successive probing RF pulses) or periodically (with a fixed intervals), or at select (preset) times.

The first unit may be fixed to, placed on, or placed in a display unit (e.g., a display table or a display cabinet). Similarly, the second unit may be fixed to or placed on a display unit within a selected distance from the first unit such that the RF signals (or the EM field) from the first unit can be received by the magnetic induction coil (or the RFID chip) in the second unit.

The connecting plate, which is tethered to the second unit via a wire rope, is affixed (e.g., using a glue, Velcro, magnetic mechanism, or another suitable means) to an exhibit object/display item (e.g., a cell phone or a tablet), and the second switch is pressed (i.e., turned on) or activated, thereby closing the circuit in the second unit to permit the magnetic induction coil to be ready to interact with the RF signals or EM fields transmitted from the first unit.

When the RF signals or electromagnetic waves from the first unit are received by the magnetic induction coil (or the RFID chip) in the second unit, a current is induced in the magnetic induction coil to activate the circuit in the second unit. The magnetic induction coil then sends the data (e.g., ID information) stored in the memory to be received by the RF transceiver in the first unit. The magnetic induction coil is used herein in a broad sense, it may be an independent coil or may be part of an RFID chip.

In the event that the RF transceiver fails to receive the data, or the received data is incorrect, or when the first switch pops up, or another fault status, it means: the first shell is removed from the exhibition table, or the distance between the second shell and the first shell is beyond the select (working) distance L, or the second switch is released, or the wire rope is cut or damaged. In this case, the microprocessor will control (trigger) the first alarm to send an alert.

Based on these simple configurations, embodiments of the present invention can provide satisfactory user experience, simple wiring, easy serviceability in poor environment, and high security.

In a preferred embodiment, a device my further comprise an indicator lamp, which may be electrically connected with the microprocessor. The rechargeable battery may be connected with an adapter via battery management chip (or a battery management circuit). Any types of rechargeable batteries known in the art may be used with embodiments of the invention. Embodiments of the invention may also use non-rechargeable batteries or use outside power source (e.g., store electrical outlets).

In accordance with other embodiments, a device may further comprise a mechanism for sensing the tension of the wire rope, a single-chip microcontroller (SCM), and/or a second alarm. As an example, the mechanism for sensing the tension of the wire rope may comprise an air sac inside the second shell. The cross section of the air sac is a circular (donut) shape, and the wire rope passes the through-hole at the center of the air sac. The wire rope is provided with a platen, and the air sac is provided with an air pressure sensor. When the wire rope is pull to a certain extent, the platen would press against the air sac to increase the pressure inside, which is sensed by the air pressure sensor. The air pressure sensor, the memory and the second alarm are all connected with the SCM. If the air pressure sensor detects an increased pressure above a threshold, the system may trigger a warning or an alarm.

In a preferred embodiment, the first and/or second alarm may comprise a siren and/or an alarm light (e.g., a flash or strobe light).

In accordance with embodiments of the invention, a method for installing and using a theft-prevention exhibition device may comprise the following steps:

(1) Install a first unit (the first shell with components included therein) on/at an exhibition table/cabinet (e.g., at a lower part). Once the first switch is pressed or turned on, the microprocessor can detect the status of the first switch according to changes in the output levels (voltages);

(2) When the microprocessor makes a determination that the first switch is pressed (or turned on), it will control the transmission of electromagnetic wave by an RF transmitter or RF transceiver to generate RF signals or electromagnetic fields in the vicinity of the first unit;

(3) Use glue (Velcro or a similar mechanism) to affix the connecting plate on the exhibit item (e.g., a cell phone or a tablet), and the second switch is turned on. Keep the distance between the second shell and the first shell within a selected distance, L, when fixing/placing the second shell on the exhibition table/cabinet;

(4) When the magnetic induction coil receives an RF signal or electromagnetic wave (e.g., EM waves from the RF transceiver), a current is induced in the magnetic induction coil, and the circuit is activated. The data information stored in the second shell (e.g., RFID information) is transmitted by the magnetic induction coil, and the transmitted information is received by the RF transceiver in the first unit;

(5) When the first switch pops up (e.g., turned off), the microprocessor may trigger an alarm from the first alarm.

When the RF transceiver in the first unit fails to receive the data information (e.g., RFID information) stored in the second unit or the data information received is incorrect, it means: the distance between the second shell and the first shell is beyond the distance L, the second switch is released, and/or the wire rope is cut off or damaged. In this case, the microprocessor may trigger an alert from the first alarm.

A preferred embodiment may further comprise an air sac, a single-chip microcontroller (an SCM), and/or a second alarm in the second unit. The cross section of the air sac is a circular (donut) shape. A wire rope passes through a through-hole at the center of the air sac. The wire rope is provided with a platen (which can press the air sac to cause air pressure changes); the air sac is provided with an air pressure (i.e., barometric) sensor. The air pressure sensor, the memory, and the second alarm are connected with the SCM.

In accordance with embodiments of the invention, the air pressure sensing may function as follows:

A customer may pull the wire rope on the retractor (i.e., the wire winder) when evaluating the displayed item. When the length of the wire rope pulled is beyond a preset distance M, the platen will press against the air sac to alter the air pressure inside the air sac. The air pressure sensor will detect a pressure increase. If the pressure in the air sac is higher than a threshold air pressure value $W_{threshold}$, an alarm or warning may be triggered.

In accordance with embodiments of the invention, the distance L between the first and second shells may be any suitable length as long as the RFID can function properly. Such distances, for example, may be 10 m, 5 m, 1 m, 0.5 m, or 0.1 m.

While the above embodiments are described using one first unit and one second unit with respective components therein, one skilled in the art would appreciate that embodiments of the invention may also involve a single first unit working with multiple second units. In this case, it would be preferable that each second unit may include a different RFID information such that the microprocessor in the first unit can tell which second unit is having abnormal situations.

Conversely, some embodiments of the invention may involve a single second unit working with multiple first units. For example, multiple first units may be placed at strategic locations in a display room and the second shell can communicate with one or more of them. As long as the second shell is in communication with at least one first shell, it is considered a normal situation. This setup would allow the second unit and its attached (tethered) display item to be moved around in the display room.

Embodiments of the present invention may have one or more of the following beneficial effects: satisfactory user experience, simple wiring, workability in adverse environment, and good safety.

Figure 1:
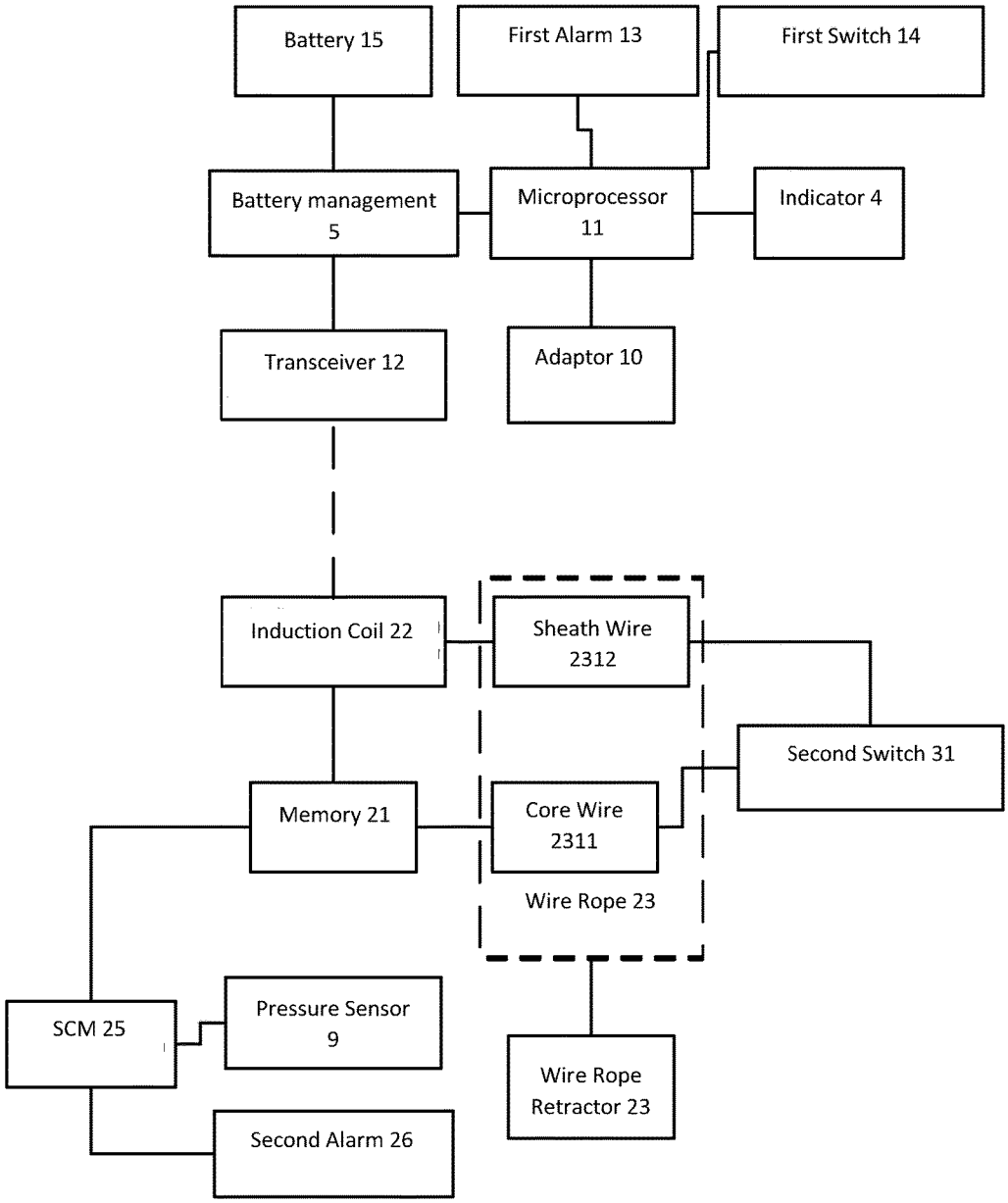
FIG. 1 is a block diagram illustrating an embodiment of the present invention.

In the FIG.: first unit 1, second unit 2, connecting plate 3, indicator lamp 4, battery pack 5, through-hole 241, platen 8, air pressure sensor 9, adapter 10, microprocessor 11, RF transceiver 12, first alarm 13, first switch 14, rechargeable battery 15, mobile phone 16, memory 21, magnetic induction coil 22, wire retractor 23, air sac 24, SCM 25, second alarm 26, second switch 31, wire rope 231, core wire 2311 and sheath wire 2312.

DETAILED DESCRIPTION

The present invention is further illustrated with the following examples in combination with drawings and preferred embodiments. One skilled in the art would appreciate that these examples are for illustration only and other modifications and variations are possible without departing from the scope of the invention.

Example 1

Figure 2:
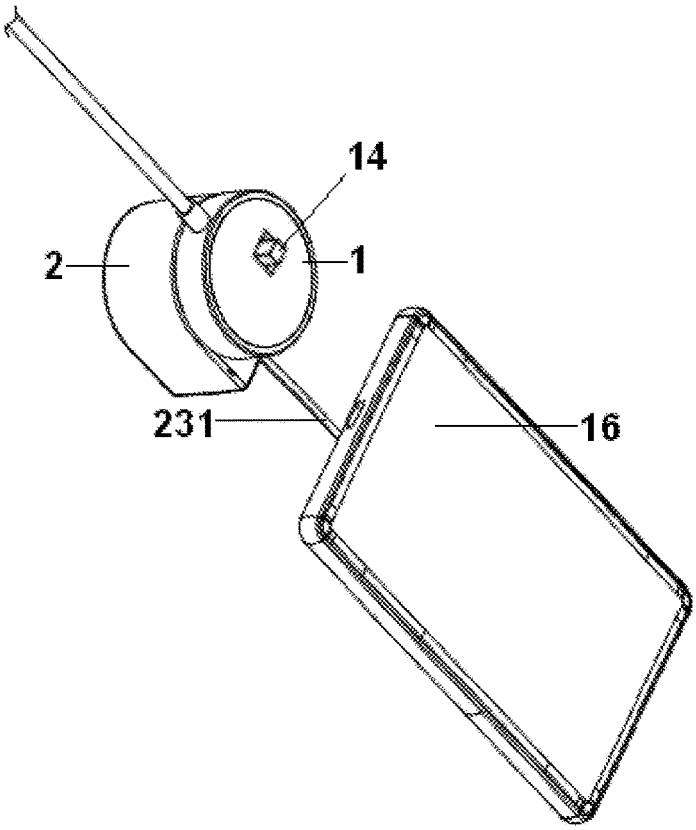
FIG. 2 is a structural diagram for an embodiment of the present invention used in display situation.
Figure 3:
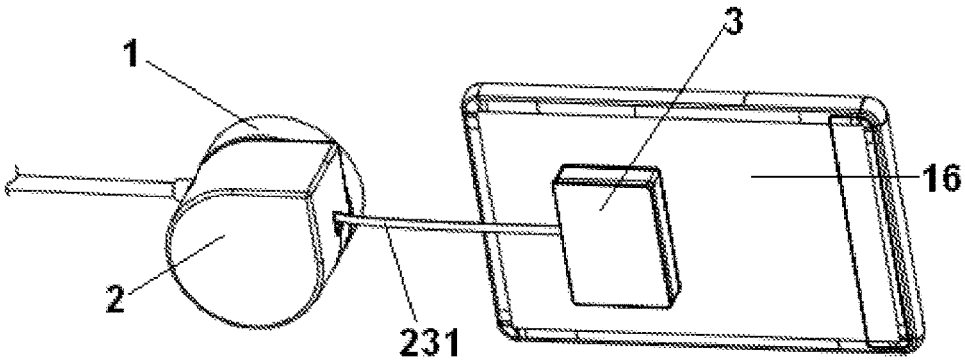
FIG. 3 is a structural diagram showing the opposite side of a display item as shown in FIG. 2.

An embodiment, shown in FIGS. 1, 2, and 3, illustrates a theft-prevention exhibition device, which comprises a first unit 1, a second unit 2, and a connecting plate 3 configured to be connected to a display item (e.g., a mobile phone or a tablet) 16. A microprocessor 11, an RF transceiver 12, a first alarm 13, a first switch 14 protruding out of the first shell, and a rechargeable battery 15 for power supply are provided in the first unit 1.

A memory 21, a magnetic induction coil 22, and a wire winder (wire retractor) 23 are provided in the second unit 2. A wire rope 231 on the wire winder is connected to a connecting plate 3 (see FIG. 3). The connecting plate 3 may be provided with a second switch 31.

As shown in FIG. 1, the wire rope 231, which may be a shielded cable, comprises a core wire 2311 and a cover (sheath) wire 2312. An insulating layer is disposed between the core wire 2311 and the sheath wire 2312. The core wire 2311, the second switch 31, the sheath wire 2312, the memory 21, and the magnetic induction coil 22 are connected in series to dorm a circuit. The microprocessor 11 is electrically connected with the RF transceiver 12, the first alarm 13, and the first switch 14.

A preferred embodiment may further comprise an indicator lamp 4, which is electrically connected with the microprocessor 11. The rechargeable battery 15 is connected with an adapter 10 via a battery pack (e.g., a battery management circuitry) 5.

A preferred embodiment of the invention may have a second unit 2 that includes therein an air sac 24, a single-chip microcontroller (SCM) 25, and a second alarm 26. The air sac 24 has a ring (donut) shape cross section, and the wire rope 231 passes through the air sac center through hole 241 (see FIG. 4). The wire rope 231 may have a platen 8, which is configured to press the air sac 24 when the wire rope 231 is pulled. The air sac 24 contains an air pressure (barometric pressure) sensor. The air pressure sensor, memory 21, and the second alarm are electrically connected with the SCM 25.

In a preferred embodiment, the first alarm 13 may comprise a loudspeaker (siren) and/or an alarm lamp (e.g., a flash or a strobe light).

Figure 5:
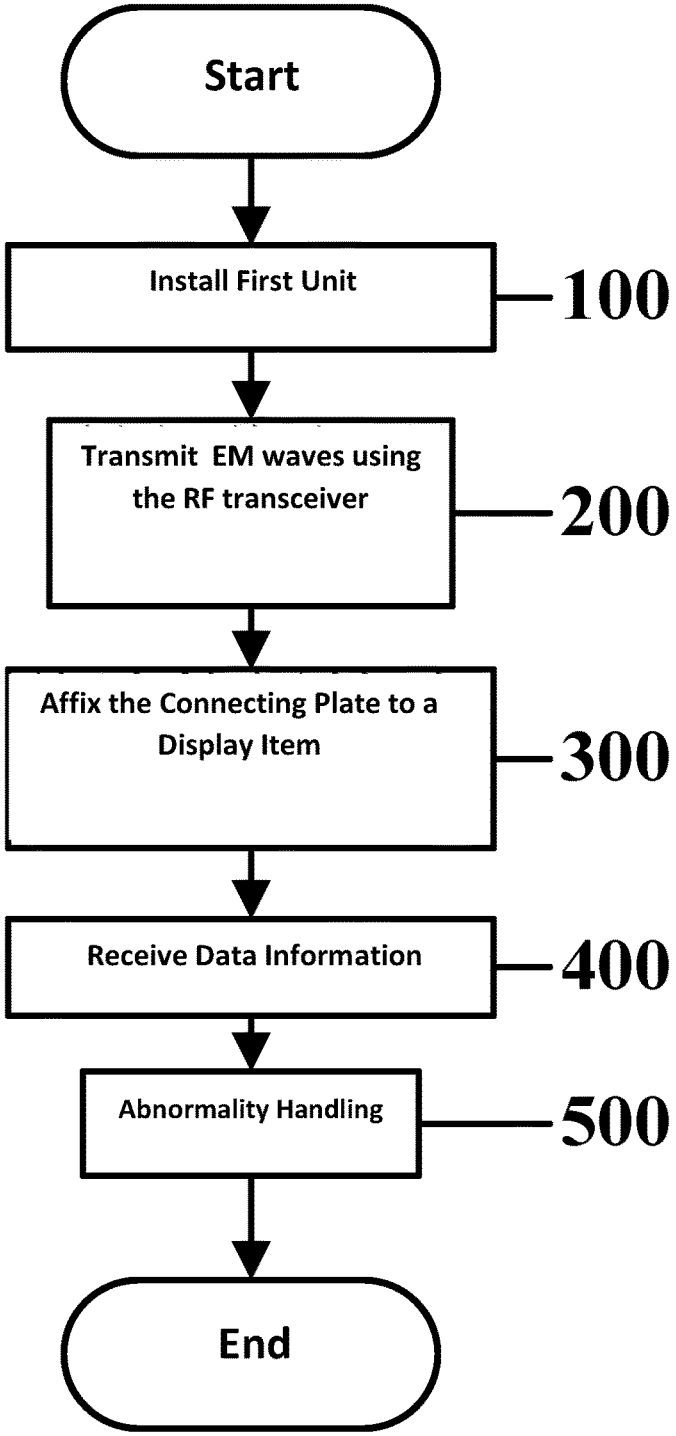
FIG. 5 is a flow chart for an embodiment of the present invention.

A method for theft-preventing an exhibition device, as shown in FIG. 5, may comprise the following steps:

Step 100: Installation of the first shell with components included therein

Install the first unit 1, for example, at a lower part of an exhibition table or in a display case. Once the first switch 14 is pressed (i.e., turned on), the microprocessor 11 will detect its status according to the changes in the output level (or voltage) from the first switch 14;

Step 200: Transmission of electromagnetic waves from the RF transceiver

When the microprocessor 11 determines that the first switch 14 is pressed (e.g., turned on), it will control the RF transceiver 12 to transmit electromagnetic waves to form an electromagnetic field in the vicinity of the first shell;

Step 300: Affixing the connecting plate to the exhibit

Use glue (or a similar mechanism) to affix the connecting plate 3 on the exhibit 16 (i.e., the display item, such as a cell phone or a tablet), thereby the second switch 31 is pressed. Keep the distance between the second unit 2 and the first unit 1 within a suitable distance L when fixing the second shell to the exhibition table or a display case. The distance L may be 15 cm, for example.

Step 400: Receiving data information

When an electromagnetic wave is received by the magnetic induction coil 22, a current is produced in the magnetic induction coil 22 and the current flows in the circuit. The magnetic induction coil 22 sends the data information (e.g., RFID information) stored in the memory 21 to be received by the RF transceiver 12;

Step 500: Abnormality handling

When the first switch 14 pops up, the microprocessor 11 will trigger the first alarm 13 to send an alarm;

When the RF transceiver 12 fails to receive the data information stored in the memory or the data information as received is incorrect, it means: the distance between the second unit 2 and the first unit 1 is beyond the distance L; the second switch 31 is released, and/or the wire rope 231 is cut off or damaged. In this case, microprocessor 11 will control the first alarm. 13 to send an alarm

Example 2

Figure 4:
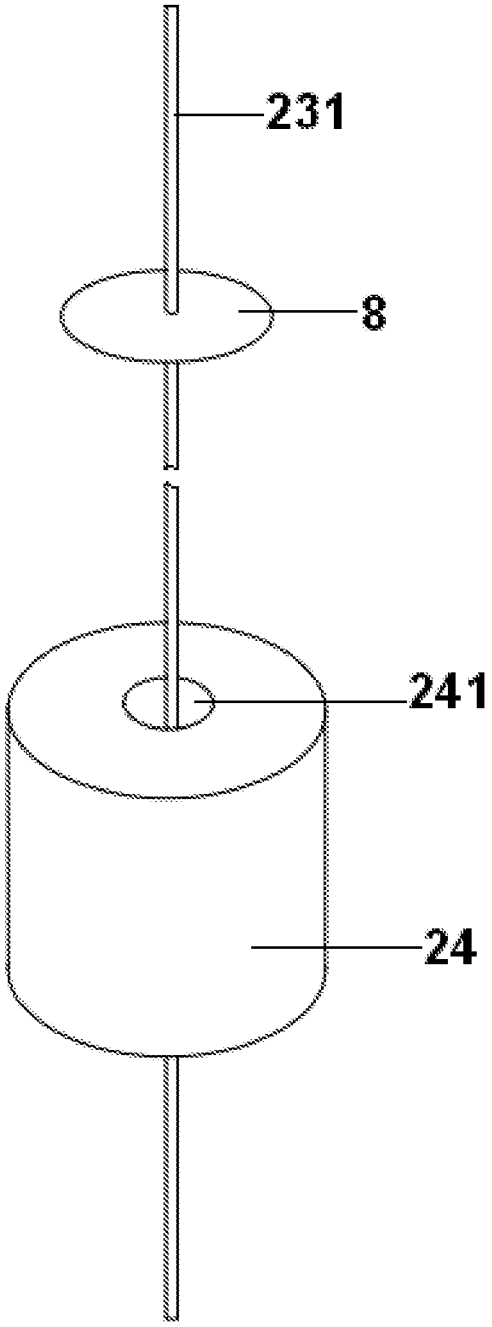
FIG. 4 is a structural diagram for an air sac in accordance with one embodiment of the present invention.

Embodiments of Example 2 comprise all structures and methods as in Embodiments 1 described above. As shown in FIG. 4, this embodiment further comprises an air sac 24, an SCM 25 and a second alarm 26 inside the second unit 2. The cross section of the air sac 24 is in a circular (donut) form; the wire rope 231 penetrates the through-hole 241 at the center of the air sac 24. The wire rope 231 is provided with a platen 8. The air sac 24 is provided with an air pressure sensor 9. The air pressure sensor 9, the memory 21, and the second alarm 26 are connected with the SCM 25.

This embodiment further comprises the following:

Customer may pull the wire rope 231 on the wire retractor (i.e., wire winder) 23 when perusing the display unit 16. When the length of the wire rope 231 pulled out of the second unit 2 reaches a preset length M (e.g., M=2 meters), the platen 8 will squeeze the air sac 24 to change the air pressure inside the air sac 24. The air pressure sensor 9 will detect an air pressure signal S(t). The SCM 25 will calculate the air pressure value W1 based on the air pressure signal S(t). And the memory 21 stores a threshold air pressure value $W_{threshold}$.

When $W1 \geq W_{threshold}$, SCM 25 will control the first alarm to send an alarm.

Example 3

Embodiments in Example 3 comprise all structures and methods as in Embodiments 2. Embodiments 3 may further comprise a step for the correction of the detection signals S(t):

The SCM 25 will select several sampling values S(t) at a time interval of Δt. The several sampling values are arranged in a time sequence to constitute a detection signal series I(t).

For each sampling value ES(t) other than the first sampling value and the last sampling value in I(t), use the Formula $$\text{ratio} = \left| \frac{|ES(t_1 + \Delta t)|^2 - |ES(t_1)|^2}{|ES(t_1)|^2 - |ES(t_1 - \Delta t)|^2} \right|$$

to calculate a stability coefficient ratio.

The SCM 25 contains preset increasing threshold values 0.5, 1 and 1.65.

If the stability coefficient ratio is within the range of [1−A1,1+A1], the sampling values ES(t) are to be corrected to B1*ES(t), wherein B1 is 0.3.

If the stability coefficient ratio within the range of (0.6, 1−A1) or (1+A1,1.65), the sampling values ES(t) are to be corrected to B2*ES(t), wherein B2 is 0.5.

Use each corrected sampling value to substitute for the corresponding sampling value in the series I(t) to obtain the corrected detection signals I'(t). Use the corrected detection signals in I'(t) to replace the detection signals S(t).

It is to be understood that the above embodiments are only used to illustrate the present invention and should not be used to limit the scope of the invention. It is to be further understood that one skilled in the art can make various variations or modifications to the present invention after reading of the contents as provided in the present invention; similarly, such equivalent forms also fall within the scope of the invention as defined by the attached Claims.

What is claimed is:

1. A theft-prevention exhibition device, comprising:

a first unit, which comprises a microprocessor, a radiofrequency (RF) transceiver, a first alarm, a first switch, a power source, wherein the microprocessor is electrically connected with the RF transceiver, the first alarm, and the first switch;

a second unit, which comprises a memory, a magnetic induction coil, and a wire retractor, wherein the magnetic coil is configured to communicate via electromagnetic waves with the radiofrequency transceiver of the first unit;

a connecting plate adapted to be connected to a display item, wherein the connecting plate comprises a second switch;

a wire rope spooled on the wire retractor and connected to the connecting plate, wherein the wire rope connects with the second switch, the memory, and the magnetic induction coil to form a circuit.

2. The theft-prevention exhibition device according to claim 1, wherein the wire rope comprises a core wire, a sheath wire, and an insulating layer disposed therebetween.

3. The theft-prevention exhibition device according to claim 1, further comprising: an indicator lamp, wherein the indicator lamp is electrically connected with the microprocessor.

4. The theft-prevention exhibition device according to claim 1, further comprising: an air sac (24), a single-chip microcontroller (SCM) (25), and a second alarm (26) in the second unit, and wherein a cross section of the air sac has a donut shape, and wherein the wire rope passes through a through-hole (241) at a center of the air sac, wherein the wire rope is provided with a platen (8), and the air sac is provided with an air pressure sensor (9), wherein the air pressure sensor, the memory and the second alarm are connected with the SCM.

5. The theft-prevention exhibition device according to claim 1, wherein the first alarm comprises a siren and/or an alarm light.

6. The theft-prevention exhibition device according to claim 1, wherein its operation comprises:

(a) installing the first unit on or at an exhibition table or cabinet; turning on the first switch, detecting a status of the first switch using the microprocessor;

(b) when the microprocessor determines the first switch is on, transmitting an electromagnetic wave using the RF transceiver;

(c) affixing the connecting plate on the display item and turning on the second switch; keeping a distance between the second unit and the first unit within a select distance L when fixing the second unit to the exhibition table or cabinet;

(d) when the electromagnetic wave is received by the magnetic induction coil, transmitting data information stored in the memory to the RF transceiver;

(e) if the first switch is off, or if the RF transceiver fails to receive the data information, or if the data information received is incorrect, triggering the first alarm.

7. The theft-prevention exhibition device according to claim 6, wherein the select distance L is <15 cm.

* * * * *